United States Patent [19]

Akkerman et al.

[11] Patent Number: 4,640,350

[45] Date of Patent: Feb. 3, 1987

[54] KICKOVER TOOL

[75] Inventors: Neil H. Akkerman, Houston; John P. Hare, Pearland, both of Tex.

[73] Assignee: AVA International Corporation, Houston, Tex.

[21] Appl. No.: 700,821

[22] Filed: Feb. 11, 1985

[51] Int. Cl.[4] ..... E21B 23/03

[52] U.S. Cl. ..... 166/117.5

[58] Field of Search ..... 166/117.5, 117.6, 240

[56] References Cited

U.S. PATENT DOCUMENTS

| | | | |
|---|---|---|---|
| 2,233,403 | 3/1941 | Dickinson et al. | 138/36 |
| 3,727,683 | 4/1973 | Terral et al. | 166/117.5 |
| 3,874,445 | 4/1975 | Terral | 166/117.5 |
| 3,876,001 | 4/1975 | Goode | 166/117.5 |
| 3,965,979 | 6/1976 | Lamb | 166/117.5 |
| 4,440,222 | 4/1984 | Pullin | 166/117.5 |

*Primary Examiner*—James A. Leppink
*Assistant Examiner*—Hoang C. Dang
*Attorney, Agent, or Firm*—Vaden, Eickenroht, Thompson & Boulware

[57] ABSTRACT

There is disclosed a kickover tool for use in running or pulling well tools respectively into or from a side pocket to one side of a bore through a mandrel connected as part of a well string.

3 Claims, 7 Drawing Figures

KICKOVER TOOL

This invention relates generally to a kickover tool for use in running or pulling well tools respectively into or from a side pocket to one side of a bore through a mandrel connected as part of a well string. More particularly, it relates to an improved kickover tool of the type shown and described in U.S. Pat. No. 3,876,001.

As shown in such patent, the kickover tool has means which is guidably moved into a generally vertical slot formed in the bore of the mandrel for cooperation with the tool in rotationally orienting the tool into a predetermined position with respect to the pocket, and then, upon its connection to or release from the well tool in the pocket, permitting the kickover tool to be withdrawn from the well string. Thus, the kickover tool includes a housing which is connectible to a wire line for raising and lowering therewith closely through the upper end of the bore, and arm pivotally connected to the housing and having means on one end from which the well tool may be suspended, and a plunger which is mounted in the housing for vertical reciprocation between an upper position in which the end of the arm is generally beneath the housing to permit the kickover tool to move through the upper end of the mandrel bore, and a lower position in which the arm is tilted to dispose its end to one side of the housing. More particularly, and as also shown in such prior patent, the orienting means of the kickover tool includes a trigger which is mounted on the plunger for movement between an outer position with respect to the housing and an inner position with respect thereto in which the orienting means may move through the upper end of the mandrel bore. The trigger is yieldably urged toward its outer position, and has a downwardly and inwardly tapered surface thereon which is slidable over obstructions within the well string to force the orienting means to its inner portion as the kickover tool is lowered into the mandrel.

The trigger also has spaced apart walls which receive a key therebetween, and the key is connected to the walls of the trigger to dispose its upper end in position to engage with a shoulder at the upper end of the slot when the trigger is in its outer position and the housing is raised to lift the orienting means into the open lower end of slot. More particularly, the shoulder of the slot and upper end of the key are so formed that, upon further lifting of the housing by means of the wireline, the plunger is lowered to tilt the arm and thus dispose the end of the arm in position for connection to or disconnection from a well tool in the pocket upon further lowering of the housing. The key is connected to the trigger by a shear pin which is releasable, when the housing is again raised to lift the upper end of the key into engagement with the slot, and the housing is jarred upwardly, to permit the key to move to a retracted and lowered position in which its upper end may be lifted past the shoulder on the key and downwardly and outwardly tapered surfaces on protruding portions of the trigger to slide over the shoulder upon further raising of the housing so as to force the orienting means into its inner position and thereby permit it to be lifted through the upper end of the mandrel bore.

It has been found, however, that the kickover tool above described often fails to perform its desired function—namely, to cause the arm to be moved into a position in which its end may be lowered for connection to or disconnection from a well tool in the side pocket of the mandrel. This is presumably due to the fact that the orienting means does not necessarily move into the slot, as it is lifted with the housing, and instead prematurely depresses and moves upwardly past the slot into the mandrel bore above it and the well string above the mandrel. This, of course, results in lost time, and may cause damage to the orienting means, particularly the trigger thereof, such that the tool must be retrieved for replacement or repair.

It is believed that as the kickover tool is lifted on the wireline, and the upper end of the key slides over one of the upwardly converging guide surfaces the lower end of the slot, the kickover tool is rotated with such momentum as to move one of its downwardly and outwardly tapered surfaces against the side edge of the slot opposite the one guide surface, and, as a result, continuing lifting of the housing forces the key and thus the orienting means inwardly before the upper end of the key is raised into engagement with the shoulder of the slot.

It is therefore the primary object of this invention to provide a kickover tool of this type which is more reliable in operation in that the orienting means will not be inadvertently moved to releasing position due to the phenomenon above described.

This and other objects are accomplished, in accordance with the illustrated embodiment of this invention, by a kickover tool of the type described in which the key of the orienting means thereof has an upper end which is disposed above the outwardly protruding portions of the trigger, when the trigger is in its outer position. Consequently, despite the momentum with which the kickover tool may be rotated as it is raised to move the orienting means into the slot, the upper end of the key, rather than protruding portions of the trigger, will be engaged with the side edges of the slot, and, due to the configuration of its upper end, the key and thus the orienting means will not be forced inwardly as the housing continues to be raised. Consequently, as intended, the orienting means will move upwardly into the slot unitl the upper end of the key engages the shoulder of the slot so that the housing may be raised further to tilt the arm in order to position its end above the pocket, and the orienting means further raised into the slot to again engage the upper end of the key with the shoulder and thus release the tool in response to an upward jar to shear a pin connecting the key to the trigger. When so released from the trigger, the key moves downwardly to a lower position in which a downwardly and outwardly tapered surface of the orienting means is slidable over the shoulder of the slot. In the illustrated and preferred embodiment of the invention, the key includes side walls which depend from its upper end on opposite sides of the trigger, and its upper end is moveable into engagement with the protruding portion of the trigger so that its upper surface forms the tapered surface which is slidable over the shoulder of the slot.

In the drawings, wherein like reference characters are used throughout to designate like parts:

FIG. 1 is a vertical sectional view of a mandrel having a side pocket and an orienting slot formed in its bore, and a kickover tool disposed within the mandrel to permit the trigger thereof to be raised into engagement with the shoulder of the slot and the arm of the tool tilted to dispose a well tool suspended therefrom above the upper end of the pocket, such mandrel and kickover tool being constructed and arranged as in the aforementioned patent;

Figure 4:
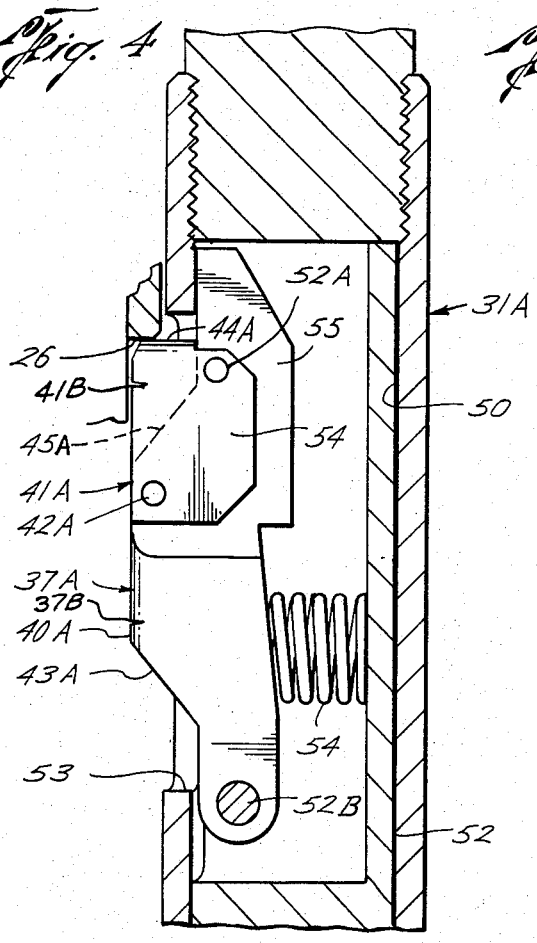
FIG. 4 is a vertical sectional view, on an enlarged scale, of a portion of the housing of the kickover tool constructed in accordance with the present invention, and showing the key and trigger disposed in their outer positions and with the upper end of the key adjacent the shoulder of the slot in a mandrel of the type shown in FIG. 1.
Figure 5:
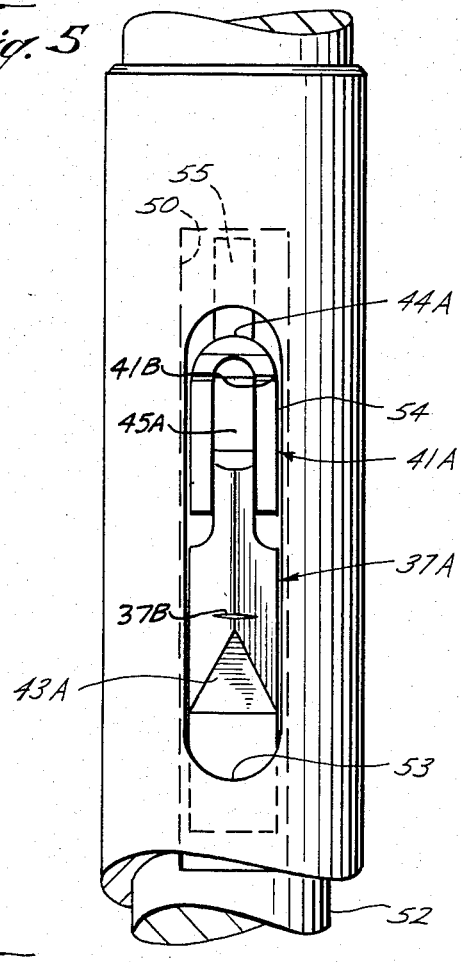
FIG. 5 is a side elevational view of the housing, as seen from the left of FIG. 4.
Figure 6:
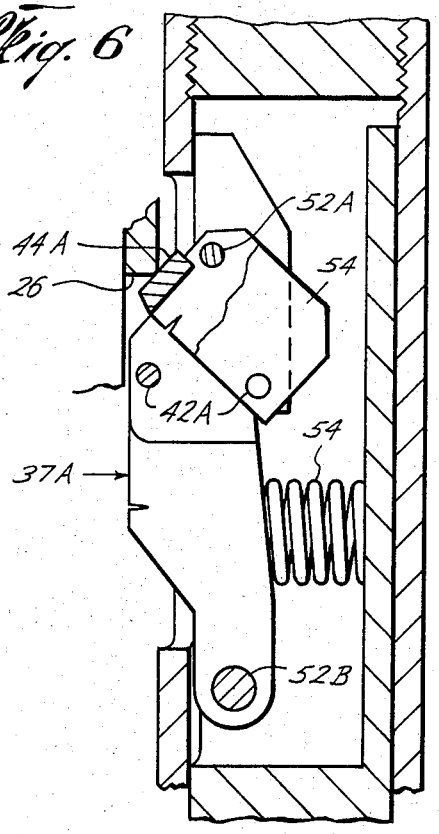
Figure 7:
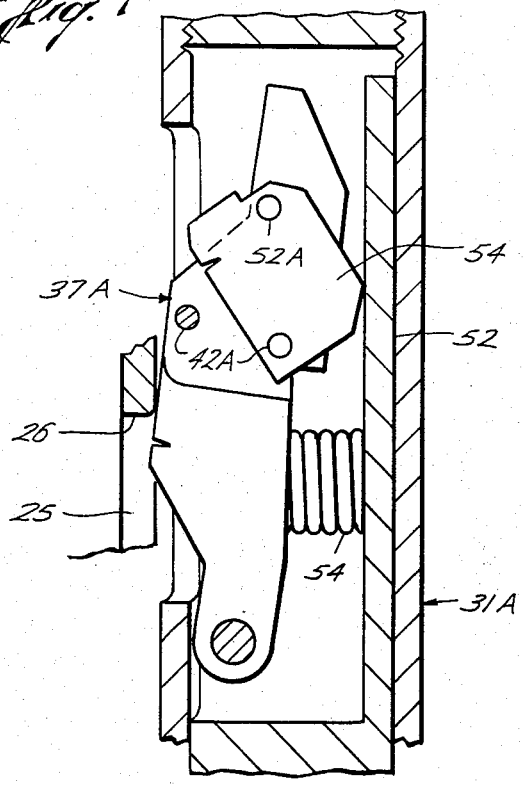

FIG. 6 is a vertical sectional view similar to FIG. 4, but upon raising of the housing to shear a pin connecting the key to the trigger and lowering of the upper end of the key into engagement with the trigger so that continued raising of the tool will force the trigger and key to outer positions to release the tool for raising from the mandrel; and FIG. 7 is a further vertical section view similar to FIGS. 4 and 6, but upon continued raising of the housing to force the key and trigger inwardly toward to positions in which the housing may be raised past the slot.

Figure 1:
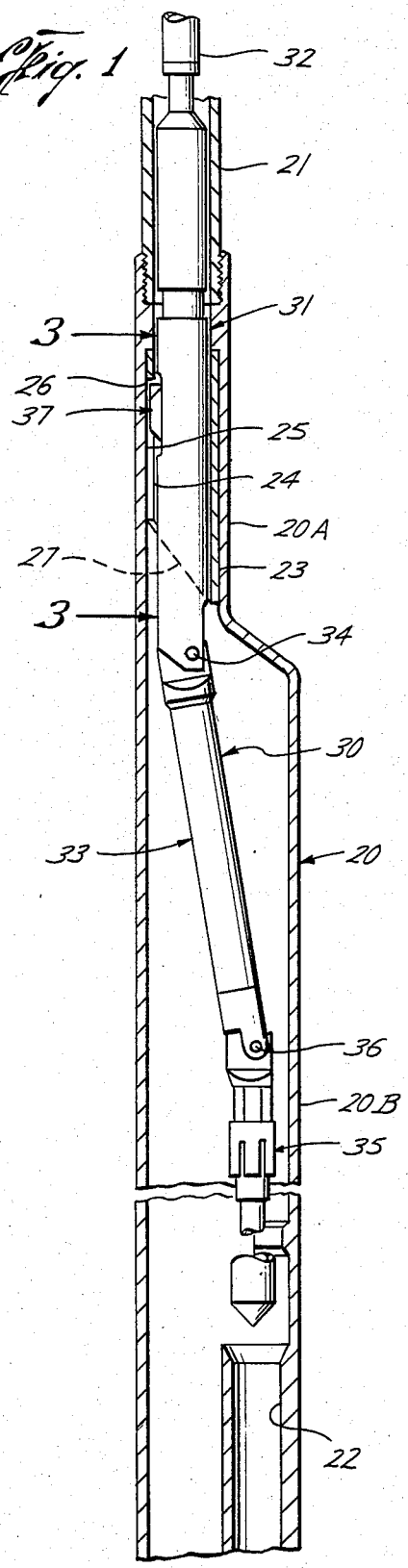
PRIOR ART Fig. 1
Figure 2:
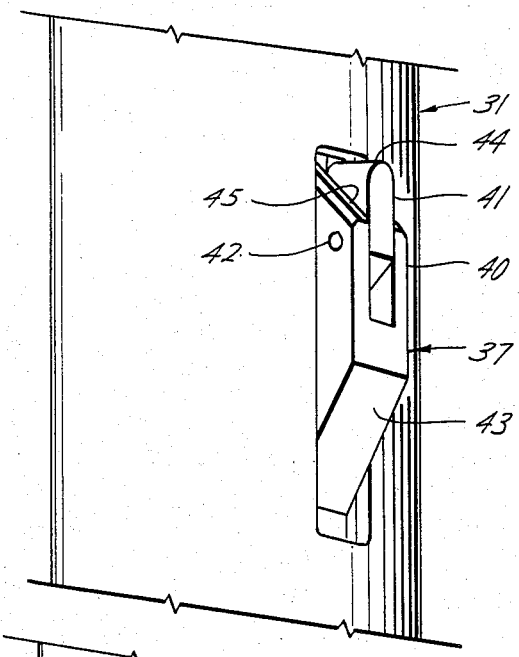
FIG. 2 is an enlarged perspective view of the outside of the kickover tool of FIG. 1, and showing the trigger and key in their outer positions.

With reference now to the details of the above described drawings, the mandrel, which is designated in its entirety by reference character 20, and shown in FIG. 1 to be connected in a well string 21, includes a tubular section 20A at its upper end having a bore which forms a continuation of the bore of the upper end of a well string 21, and an enlarged section 20B which has a pocket 22 formed herein to one side of a lower continuation of the bore through the tubular section 20A. As well known in the art, the mandrel also has a lower tubular section (not shown) which is arranged coaxially of the upper tubular section 20A to form the lower end of the mandrel bore and which is connected to a lower continuation of the well string.

The upper section 20A of the mandrel includes a tubular insert 23 forming the upper end 24 bore of the mandrel and having a vertical slot 25 machined therein. As shown in FIG. 1, the slot has an abrupt shoulder 26 at its upper end, and upwardly converging guide surfaces 27 at its open lower end.

Like the mandrel 20, the kickover tool, which is designated in its entirety by reference character 30 is substantially identical to that shown in the aformentioned patent. Thus, as explained in that patent, the kickover tool includes a housing 31 at its upper end adapted to be supported from the lower end of a wireline 32, and an arm 33 pivotally connected by a pin 34 to the lower end of the housing. A well tool 35 is pivotally connected by pin 36 to the lower end of the arm 33 so that it is suspended in a vertical position. Thus, upon tilting of the arm to the position shown in FIG. 1, its lower end is to one side of the housing, so that, upon orientation of the kickover tool into a predetermined rotational position, the well tool 35 is above the pocket 22 whereby it may be lowered into the pocket.

As also described in the aforementioned patent, and as will be apparent from the description to follow of the improved kickover tool of the present invention, the housing 31 has a chamber formed therein in which a means 37 is received for movement between an inner position in which it may move through the well string and into and out of the upper end of the mandrel bore, and an outer position in which, as shown in FIGS. 1, it is closely received within the slot 25.

As further described in the aforementioned patent, the orienting means 37 is mounted on a plunger adapted to reciprocate vertically within the housing, so that upon raising of the orienting means into the slot, and engagement with the shoulder 26 of the slot, further raising of the housing 31 by means of the wireline 32 will lower the plunger within the housing. The lower end of this plunger has a surface thereon which is offset to the left of the pivot pin 34, and which engages the upper end of the arm 33 to move it to the tilted position of FIG. 1 as the plunger is so lowered. When the arm has been tilted in this position, it is temporarily locked therein, so that, upon lowering of the kickover tool from the position of FIG. 1, the well tool 35 may be lowered into the pocket 22.

The orienting means includes a trigger 40 having a lower end (not shown) which is pivotally connected to the plunger and yieldably urged to its outer position, and a key 41 which is pivotally connected to the upper end of the trigger and releasably connected to an intermediate portion thereof my means of a shear pin 42. More particularly, the trigger includes spaced apart walls between which the key 41 is recieved and having downwardly and inwardly tapered surfaces 43 which protrude from the housing, when the orienting means is in its outer position. Thus, the surfaces 43 will slide over obstructions in the well string upon lowering of the kickover tool into the mandrel.

The upper end of the key 41 has an abrupt surface 44 thereon which is adapted to engage the shoulder 26 of the slot, and thereby prevent raising of the orienting means as long as the key remains connected to the trigger by means of the shear pin 42. Consequently, when the kickover tool is raised toward the position of FIG. 1, the upper surface 44 and the key 41 is intended to slide over a guide surface 27 and thus move the orienting means into a position in which it will move upwardly into the slot 25 to engage surface 44 with the shoulder 26 at the upper end of the slot, so that further raising of the housing will force the plunger dowardly to tilt the arm 33 to the position of FIG. 1, and thereby dispose the lower end of the arm above the pocket, all for purposes previously described.

Upon lowering of the well tool into the pocket, and disconnection of the lower end of the arm therefrom, the kickover tool is lowered to seat the well tool 35 in the pocket following which the lower end of the arm is disconnected therefrom. Then, upon raising the kickover tool, the orienting means is again intended to be guided into the slot 26 to engage the surface 44 with the shoulder 26. Then, in order to release the kickover tool for retrieval from the well string, it is jarred upwardly by means of the wireline so as to shear the pin 42, and thus permit the key to swing downwardly about its pivotal connection to the upper end the trigger. As the housing is raised further, downwardly and outwardly tapered surfaces 45 on the upper ends of the side walls of the trigger 37 are intended to slide over the slot shoulder 26, and thus force the orienting means inwardly to its inner position, whereby the kickover tool may be well raised from the well string. As the kickover tool is raised, the arm 33 is moved upwardly to engage with the lower end of the upper end of the mandrel bore, which causes it to be released from its tilted position, whereby the arm and the well tool suspended therefrom may be raised with the housing.

Figure 3:
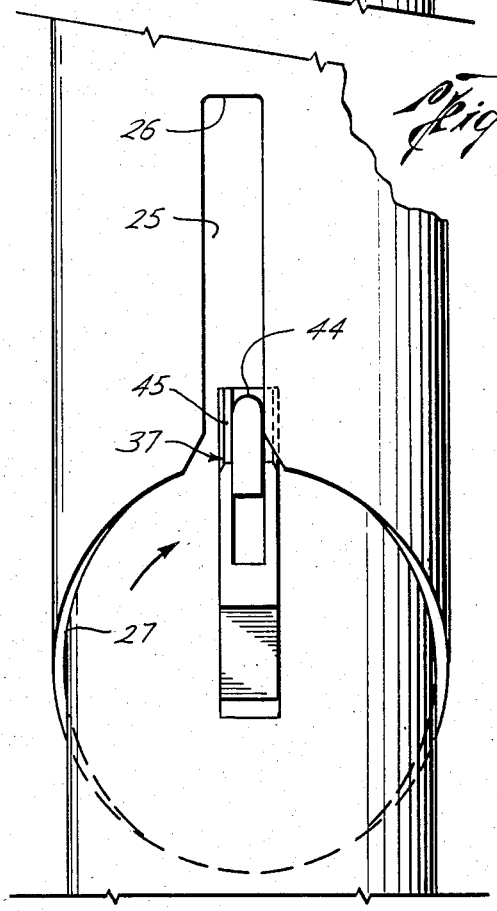
FIG. 3 is a view from the outer side of the slot to show the downwardly and outwardly tapered surface on one side wall of the key engaging a side edge of the slot.

As previously described, although the kickover tool is intended to operate in the manner above described, it is believed that instead a guide surface 45 on one of the side walls of the trigger 40 may rotate into a position beneath one side edge of the slot 26, as shown in FIG. 3, so that, upon continued raising of the well tool, the orienting means is forced inwardly before the surface 44 at the upper end of the key 41 engages the shoulder 26 of the slot.

In accordance with my invention, the mandrel may be of the identical construction above described and disclosed the aforementioned patent. Furthermore, the kickover tool may also be identical in many respects to that of the forementioned patent. Thus, as shown in FIGS. 4 to 7, it may include a housing 31A having a chamber 50 formed therein to receive a plunger 51 for vertical reciprocation therein, and an orienting means 37A mounted on the upper end of the plunger for movement through a window 53 in the side of the housing 31A betewen an inner position and the outer position shown in each of FIGS. 4 to 6. As in the kickover tool of the aforementioned patent, the orienting means includes a trigger 40A having its lower end pivotally connected by a pin 52B, and a key 41A pivotally connected to the upper end of the trigger by means of a pin 52A and releasably connected to the trigger by means of a shear pin 42A. A coil spring 54 is disposed between the inner side of the trigger and an inner wall of the plunger so as to yieldably urge the orienting means to the outer position shown in FIGS. 4 to 6.

However, as previously described, the orienting means 37A differs in other respects from that of the orienting means 37 of the prior kickover tool in order to accomplish the objects of the invention. Thus, the key 41A is in the form of an inverted "U" having an upper end 44A from which side walls 54 depend on opposite sides of the reduced upper end 55 of the trigger 40A. The upper surface 44A of the upper end of the key is abrupt, like the surface 44 of the key 41, so as to cooperate with the abrupt shoulder 26 at the upper end of the slot 25. Also, the trigger has an upwardly and outwardly tapered surface 43A beneath the key which is adapted to slide over obstructions in the wellstring, and thus force the orienting means 37 into its inner position, as the kickover tool is lowered into close fitting relation within the upper end of the mandrel bore.

Due to this novel construction of the orienting means 37A, the upper end of the key is disposed above downwardly and outwardly tapered surfaces 45A on the protruding portion of the trigger 40A. Consequently, even though the momentum of the kickover tool may swing it into a position beneath one side edge of the slot 26 in the mandrel, the orienting means will not be forced inwardly as the kickover tool continues to be lifted. That is, the abrupt surface 44A of the key, rather than the tapered surfaces 45A of the trigger, will be raised into engagement with the lower edge of the slot to cam the orienting means into alignment with the slot, whereby further raising of the housing by means of the wireline will move the key upwardly into the slot until its upper end engages shoulder 26, following which further raising of the housing will force the plunger 52 downwardly so as to tilt the arm of the kickover tool into a position in which is lower end is above the pocket of the mandrel.

Then, as in the operation of the kickover of the prior patent, the kickover tool may lower a well tool into the pocket 22, or lower its arm into a position for connection with a well tool in the pocket 22. Following disconnection of the arm from the well tool, or connection of the arm to a well tool in the pocket, the kickover tool may again be raised by means of the wireline so as to move the orienting means 37A guideably into the slot 25, until the abrupt surface 44A on the upper end of the key 41A again engages the slot shoulder 26. At this time, an upward jar imparted by the wireline will shear the pin 42A and thus permit the key 41A to swing downwardly into the position shown in FIG. 6, wherein the lower side of its upper end 44A rests upon the tapered surface 45A of the trigger and the upper surface thereof assumes a downwardly and outwardly tapered position. Thus, as shown in FIG. 7, upon continued raising of the housing, it will slide over the shoulder 26 of the slot so as to force the orienting means inwardly, and thereby permit release of the kickover tool from within the mandrel.

As shown, the upper outer corner of the key 41A is beveled as to lessen the likelihood of the tool being hung up by the downwardly facing obstruction in the well bore as it is raised therein. Also, the outer edge of each of the key and trigger 37A is notched at 41B and 37B, respectively, to provide means for indicating wear during use of the tool. Thus, the operator may observe wear as the notches become shallower over a period of time.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. For use in running or pulling well tools respectively into or from a side pocket to one side of a bore through a mandrel of a well string, wherein there is a generally vertical slot in the bore of the mandrel which has a shoulder at its upper end and which has upwardly converging guide surfaces on its open lower end; a kickover tool comprising a housing connectible to a wire line for raising and lowering therewith closely through the upper end of the bore, an arm pivotally connected to the housing and having means on one end from which the well tool may be suspended, a plunger mounted in the housing for vertical reciprocation between an upper position in which the end of the arm is generally beneath housing to permit the kickover tool to move through the upper end of the mandrel bore, and a lower position in which the arm is tilted to dispose its end to one side of the housing, and means guidably movable into the slot for rotationally orienting the end of the tilted arm into a position above the pocket, including a trigger mounted on the plunger for movement between an outer position with respect to the housing in which a portion of the trigger protrudes from the housing and an inner position with respect thereto in which the orienting means may move through the upper end of the mandrel bore, means yieldably urging the trigger toward its outer position, said trigger having a surface on the uppermost end of the protruding portion, and a key connected to the trigger to dispose its upper end directly above the said trigger surface, when the trigger is in its outer position, and thus to engage with the shoulder of the slot as the housing is raised to lift the orienting means into the slot, whereby the housing may be raised further so as to lower the plunger and locate the end of the tilted arm above the pocket, and then lowered to permit said end of the arm to be connected to or disconnected from a well tool in the pocket, said connection of the key to the trigger being releasable when the housing is again raised to lift the upper end of the key into engagement with the shoulder of the slot and the housing is jarred upwardly, to permit the key to move to a lower position in which a downwardly and outwardly tapered surface on one of said trigger and key is slidable over the shoulder of the slot, as the housing is further raised, to force the orienting means into its inner position and thus permit it to be lifted through the upper end of the mandrel bore with the housing.

2. A kickover tool of the character defined in claim 1, wherein the key includes side walls which depend from its upper end on opposite sides of the trigger, and said upper end is moveable into engagement with said surface of the trigger so that it forms the surface which is slidable over the shoulder of the slot.

3. A kickover tool of the character defined in claim 1, wherein each of the trigger and key has an outer edge with a notch therein to indicate wear.

* * * * *